US007005807B1

(12) United States Patent
Ha et al.

(10) Patent No.: US 7,005,807 B1
(45) Date of Patent: Feb. 28, 2006

(54) NEGATIVE VOLTAGE DRIVING OF A CARBON NANOTUBE FIELD EMISSIVE DISPLAY

(75) Inventors: Chang Chul Ha, San Jose, CA (US); Lee Choon Rae, San Jose, CA (US)

(73) Assignee: cDream Corporation, San Jose, CA (US)

( * ) Notice: Subject to any disclaimer, the term of this patent is extended or adjusted under 35 U.S.C. 154(b) by 0 days.

(21) Appl. No.: 10/160,921

(22) Filed: May 30, 2002

(51) Int. Cl.
*G09G 3/10* (2006.01)

(52) U.S. Cl. ..... 315/169.1; 315/169.3

(58) Field of Classification Search ..... 315/169.3, 315/169.1, 169.2; 345/75.2, 36, 45, 76; 313/309, 313/310

See application file for complete search history.

(56) References Cited

U.S. PATENT DOCUMENTS 5,252,833 A * 10/1993 Kane et al. ..... 250/423 F
6,057,636 A * 5/2000 Sakai et al. ..... 313/306
6,204,597 B1 * 3/2001 Xie et al. ..... 313/310
6,236,156 B1 * 5/2001 Ito ..... 313/495
6,255,772 B1 * 7/2001 Cathey et al. ..... 313/495
6,364,730 B1 * 4/2002 Jaskie et al. ..... 445/24
6,441,559 B1 * 8/2002 Yamamoto et al. ..... 315/169.1
6,495,965 B1 * 12/2002 Yamaura et al. ..... 315/167
6,583,582 B1 * 6/2003 Ichikawa ..... 315/169.3
6,727,637 B1 * 4/2004 Williams ..... 313/293
2002/0079802 A1 * 6/2002 Inoue et al. ..... 313/309

* cited by examiner

*Primary Examiner*—Trinh Vo Dinh
(74) *Attorney, Agent, or Firm*—Fenwick & West LLP

(57) ABSTRACT

An electron-emitting display device contains an emitter electrode, an anode and a gate electrode and an electron emission control device. The electron emission control device includes a plurality of voltage controllers which applies a positive voltage charge to the anode and emitter electrode respective. A third voltage controller applies a negative voltage charge to the gate inhibiting electron emission from electron emissive elements in the display device.

20 Claims, 7 Drawing Sheets

Driving Signal Sequence

NEGATIVE VOLTAGE DRIVING OF A CARBON NANOTUBE FIELD EMISSIVE DISPLAY

FIELD OF USE

This invention relates to carbon based field emitters. More particularly, this invention relates to flat panel carbon-emitter based field emission displays.

BACKGROUND

A flat-panel CRT display basically consists of an electron-emitting device and a light-emitting device that operate at low internal pressure. The electron-emitting device, commonly referred to as a cathode, contains electron-emissive elements that emit electrons over a wide area.

The emitted electrons are directed towards light-emissive elements distributed over a corresponding area in the light-emitting device. Upon being struck by the electrons, the light-emissive elements emit light that produces an image on the viewing surface of the display.

When the electron-emitting device operates according to field-emission principles, electrically conductive emitter material is commonly placed in series with the electron-emissive elements to gate the magnitude of current flow through the electron-emissive elements. FIG. 1 illustrates a conventional field-emission device, that so utilizes the conductive emitter material.

In the field emitter of FIG. 1, illustrates a multi-layer structure 100 which is a cross sectional view of a portion of an FED flat panel display. The multi-layer structure 100 comprises a field emission backplate structure 110. An image is generated at faceplate structure 120.

The backplate structure 110 generally comprises of an electrically insulating layer 111, a patterned gate electrode 112, and a conical electron-emissive element 113 situated in an aperture through insulating layer 111.

One type of electron emissive elements 113 is described in Spindt et al. U.S. Pat. No. 3,665,241. Spindt describes vertical field emission cathode/field ionizer structures in which "needle-like" elements such as conical or pyramidal tips are formed on a (typically conductive or semicondictive) substrate. Faceplate structure 120 is formed with a reflective layer 121, an anode comprising a reflective layer 121 and a black matrix layer 122, and a coating of phosphors 123.

The emission of electrons from electron-emissive elements 113 is controlled by applying a suitable voltage ($V_g$) to the gate 112. Another voltage ($V_e$) is applied directly to the electron emissive element 113 by way of the emitter electrode 114. Electron emission increases as the gate-to-emitter voltage, e.g., $V_{ge}$ is increased. Directing the electrons to the phosphor 123 is performed by applying a high voltage ($V_a$) to the anode 120.

When a suitable gate-to-emitter voltage ($V_{ge}$) is applied, electrons are emitted from electron-emissive element 113 at various values of off-normal emission angle theta 130. The emitted electrons follow non-linear trajectories indicated by lines 101 and impact on a target portion of phosphor 123. Thus, $V_g$ and $V_e$ determine the magnitude of the emission current ($I_e$) while the anode voltage ($V_a$) controls the direction of the electron trajectories for a given electron emitted at a given time.

FIG. 2 illustrates another prior art electron-emissive structure. In the prior art structure shown in FIG. 2, a focus structure 115 is added to the backplate structure 110 to focus the electron beam more directly towards the faceplate structure 120. A focus voltage $V_f$ is applied to the focus structure 115 to more accurate direct the electrons emitted from elements 113 to the phosphor 123.

FIG. 3 illustrates a portion of an exemplary FED screen 110. The FED screen 110 is subdivided into an array of horizontally aligned rows and vertically aligned columns of pixels. The boundaries of a respective pixel are indicated by dashed lines. Three separate row lines 311–313 are shown. Each row line 311–313 is a row electrode for one or the rows of pixel in the array.

In one embodiment, each row line 311–313 is coupled to the emitter electrodes of each emitter of the particular row associated with the electrode. A portion of one pixel row is shown in FIG. 2 and is situated between a pair of adjacent spacers. In color displays, each column of pixels has three column lines: (1) for red; (2) a second for green and (3) a third for blue. Likewise, each pixel column includes one of each phosphor stripes (red,green,blue) three stripes total.

In operation, the red, green and blue phosphor stripes are maintained at a high positive voltage relative to the voltage of the emitter electrode. When one of the sets of electron-emission elements is suitably excited by adjusting the voltage of the corresponding row lines and column lines, elements 113 in that set emit electrons which are accelerated towards a target portion of the phosphor in the corresponding color. The excited phosphors then emit light.

During a screen frame refresh cycle, each row line is activated in order from the first row to the last row and only one row is active at a given time and the column lines are energized to illuminate the one row of pixels for the on-time period. This is performed sequentially in time row-by-row.

According to an embodiment of the prior art, and anode is enabled by application of a predetermine threshold voltage (e.g. 300V). After the anode is enabled and has reached the threshold voltage, the emitter electrode and the gate electrode are the respectively enabled. The cathode may be enabled for a pre-determine period of time after the anode has been enabled to direct electrons towards the anode 120 and to prevent electrons from striking the gate electrode.

As a voltage differential is created by the gate electrode and the emitter electrode, electrons tend to strike the gate electrode rather than the anode 120. This situation can lead to overheating which may affect the voltage differential between the gate electrode and the emitters 113.

In addition, as the electrons jump the gap between the electron-emission elements 113 and the gate electrode, a luminous leakage of current may also be observed. Severe damage to the electron emitter may thus occur.

To solve the problem of electron depletion and discharge and the potential arching and depletion in the FED device.

In the device shown in FIG. 2, a focus structure comprising a focus electrode 115 is fabricated on the gate electrode 112 to provide a means of accurately focusing electrons to the anode structure 122. Although the focus structure 115 helps in alleviating the electron depletion problem of the prior art, this prior art solution adds additional fabrication steps to fabricating the FED device. This can be time consuming and costly.

It is therefore desirable to have a FED device that provides a reduce-electron depletion structure without additional fabricated structures in the device.

GENERAL DISCLOSURE OF THE INVENTION

The present invention furnishes an electron-emitting device having an enhanced emitter to anode control system to meet the foregoing needs. The present invention also includes an emitter to gate control system to control electron emission from the electron emissive elements of the present invention to the anode structure of the invention.

In another general embodiment of the present invention includes a mechanism to negatively bias a gate layer of a cathode structure relative to an emitter electrode of the cathode structure to control electron emission from electron elements coupled to the emitter electrode. electrodes.

Another embodiment of the present invention includes a gate control system that applies a negative potential to the gate of the cathode structure of the invention in order to inhibit the emission of electrons from the electron emissive elements. Applying the negative potential to the gate as mentioned allows the present invention to implement gray scale control of images in a display device.

Embodiments of the present invention further include an anode control system that includes an anode voltage application mechanism that applies a positive voltage charge to the anode over a certain threshold value. A further application of voltage to the anode over this threshold value allows the anode to implement a full brightness display characteristics of a display device having a carbon based emitter elements.

Embodiments of the present invention further includes a gate voltage application mechanism for applying a negative voltage to the gate of the cathode structure of the present invention. By applying a negative potential to the gate of the cathode structure, the present invention creates a negative potential field between the emitter electrode and the gate thereby preventing electrons emitter by the electron emissive elements from being leaked out of the cathode structure.

To manufacture an electron-emitting device that employs the electron control system of the invention, a structure is typically first provided in which a gate electrode overlies a dielectric layer that overlies an electrically resistor layer overlying an emitter electrode.

Electron-emissive elements are situated in a composite opening extending through the gate electrode and dielectric layer in the structure so that the electron-emissive element overlies the seed layer and the patterned resistor layer above the emitter electrode. Creation of the resistor sections involves removing portions of the resistor layer located generally below spaces situated to the sides of the gate electrode.

Again, there is no need to perform an extra masking step to provide this initial patterning to the resistor layer. The net result is that the desired pattern can be provided in the resistor layer without increasing the number of masking steps.

In some applications, a separate masking step may be employed in providing the requisite pattern in the resistor layer. Use of a separate masking step may arise as a matter of process convenience or due to overall processing constraints.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

In the present invention, a patterned resistor layer connected in series with electron-emissive elements of an electron-emitting device is patterned into multiple sections laterally separated along each emitter electrode in the device. The electron emitter of the invention typically operates according to field-emission principles in producing electrons that cause visible light to be created from corresponding light-emissive phosphor elements of a light-emitting device. The combination of the electron-emitting device, often referred to as a field emitter, and the light-emitting device forms a cathode-ray tube of a flat-panel display such as a flat-panel television or a flat-panel video monitor for a personal computer, a lap-top computer, or a workstation.

Reference will now be made in detail to the present embodiments of the invention, examples of which are illustrated in the accompanying drawings. While the invention will be described in conjunction with the present embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following description, for purposes of explanation, numerous specific details are set forth in order to provide a thorough understanding of the present invention. It will be apparent, however, to one skilled in the art, upon reading this disclosure, that the present invention may be practiced without those specific details. In other instances, well-known structures and devices are not described in detail in order to avoid obscuring aspects of the present invention.

The present invention provides a structure and a method of operating a field emission display to improve the FED driving condition & emission characteristics and also to eliminate process for additional focusing structure.

Figure 1:
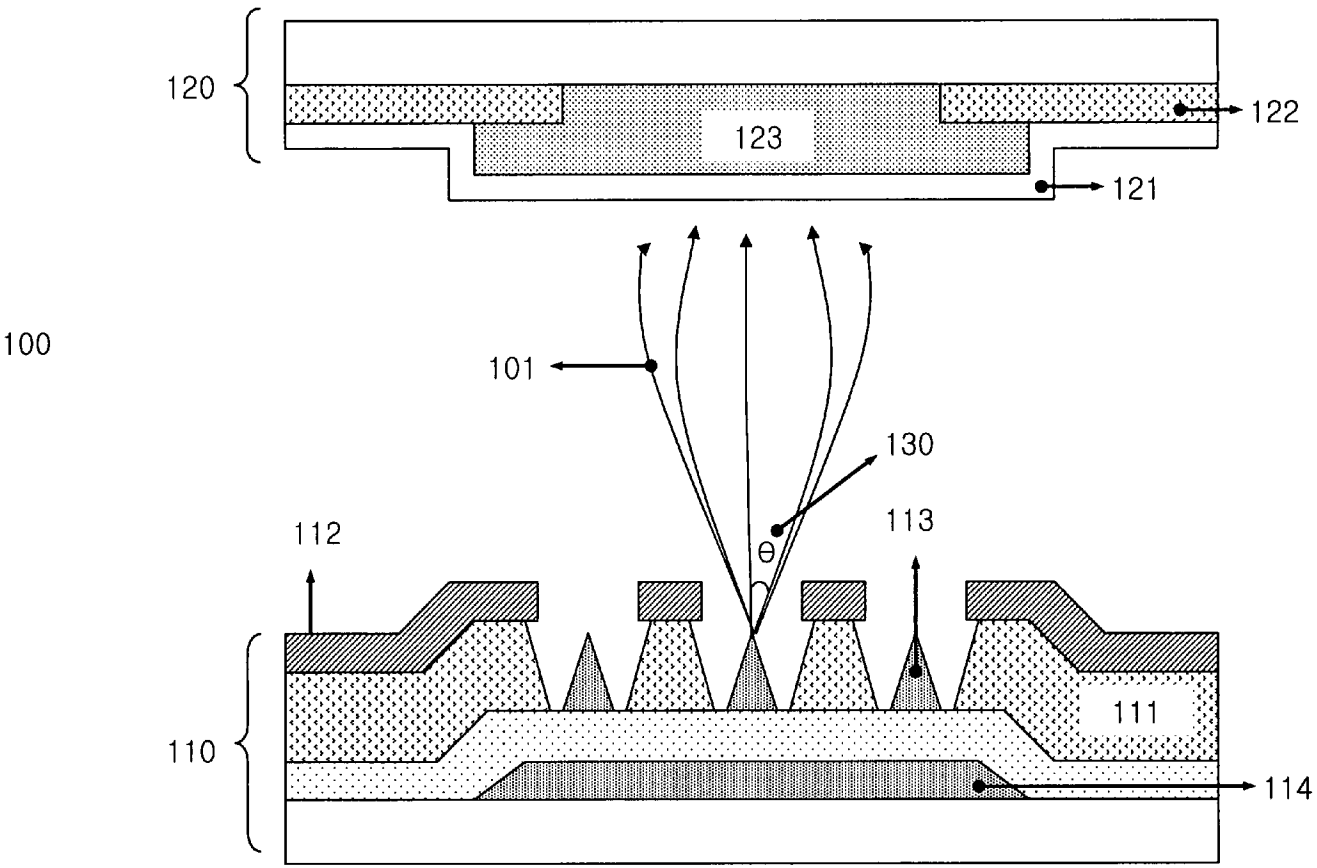
FIG 1 PRIOR ART
FIG. 1 is a cross-sectional view of the core of a conventional electron-emitting device.
Figure 2:
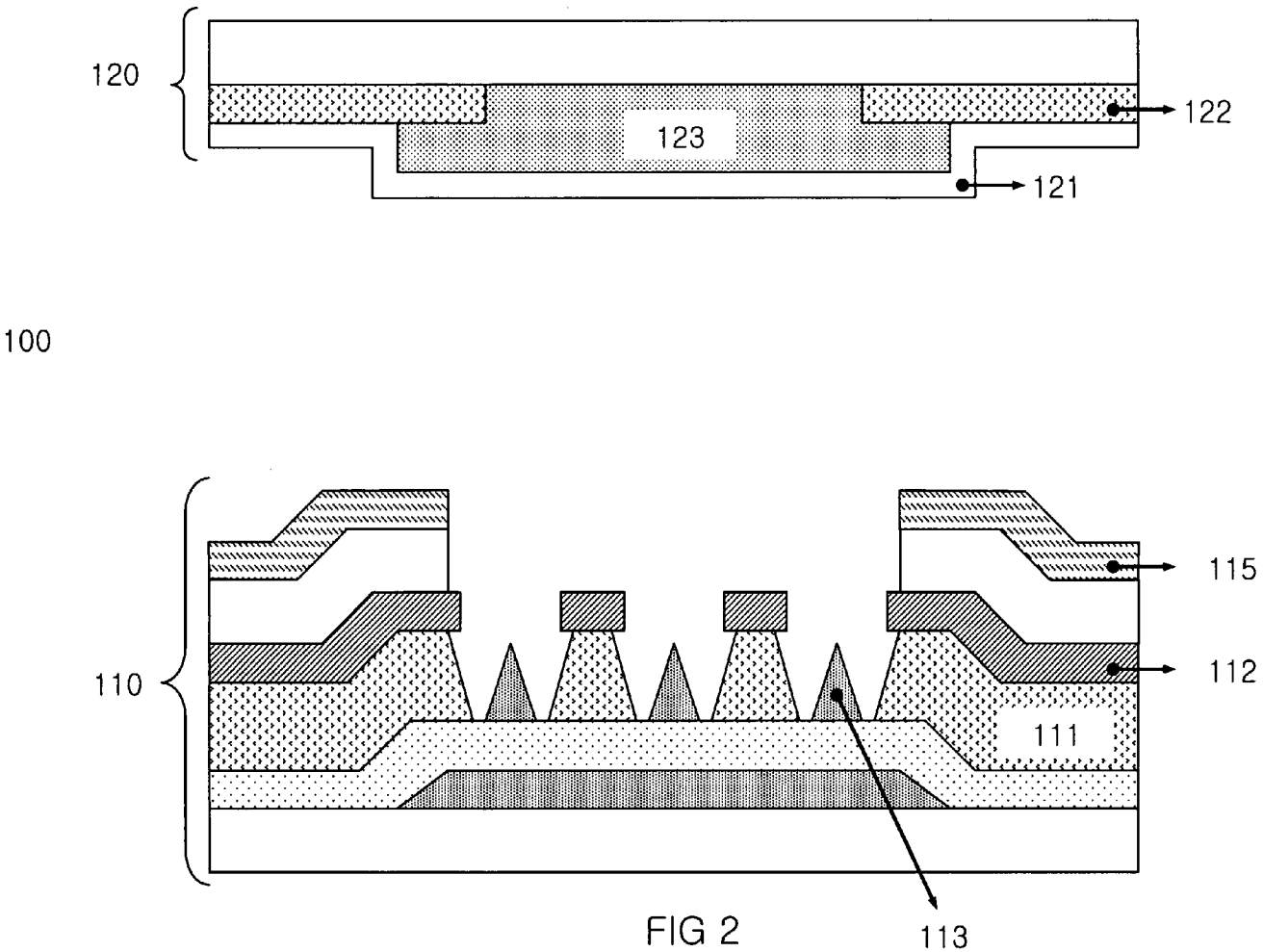
FIG 2 PRIOR ART
FIG. 2 is a cross-sectional view of a conventional electron-emitting device showing a focus region.
Figure 3:
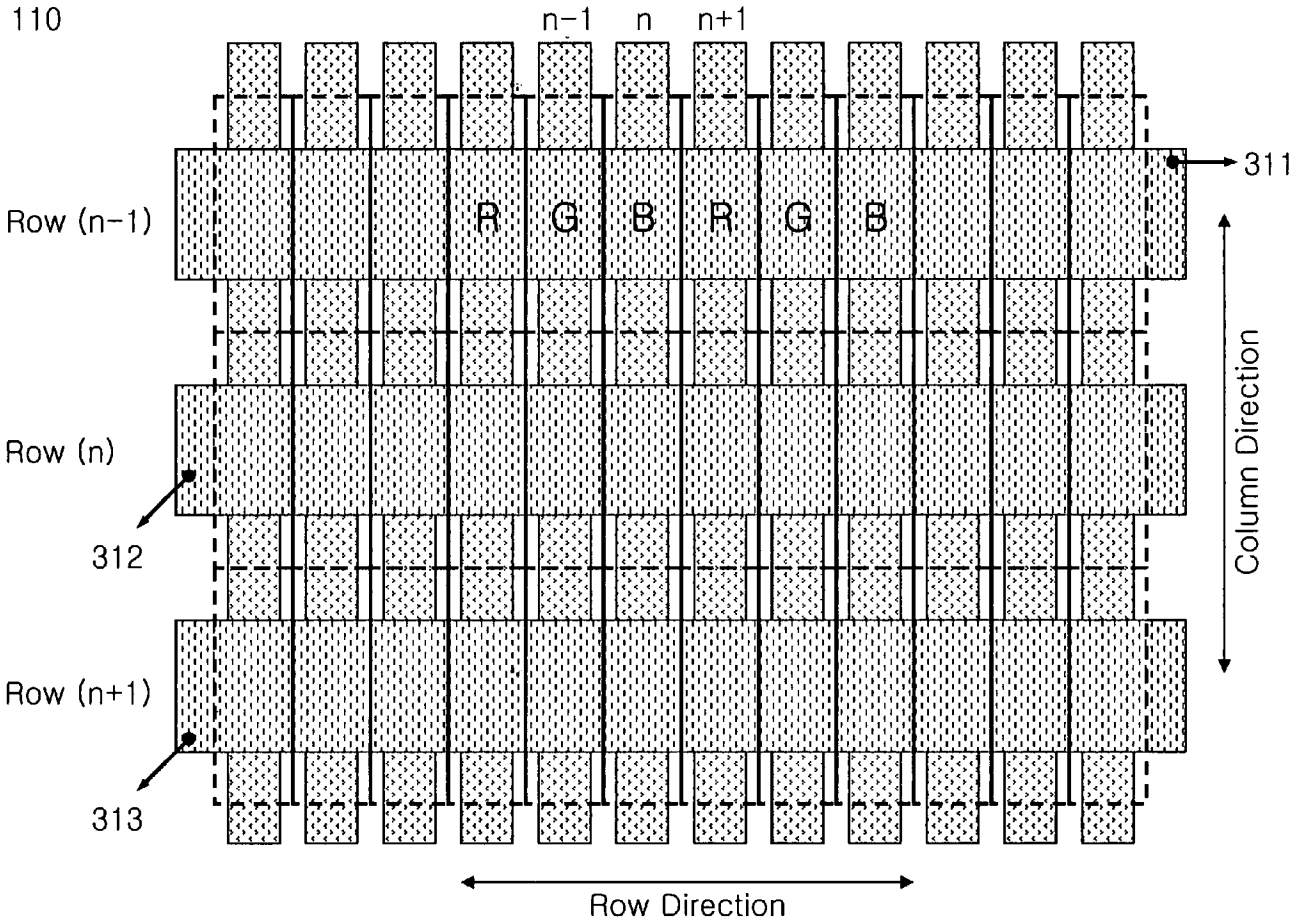
FIG 3 PRIOR ART
FIG. 3 illustrates an exemplary FED screen of the prior art.
Figure 4:
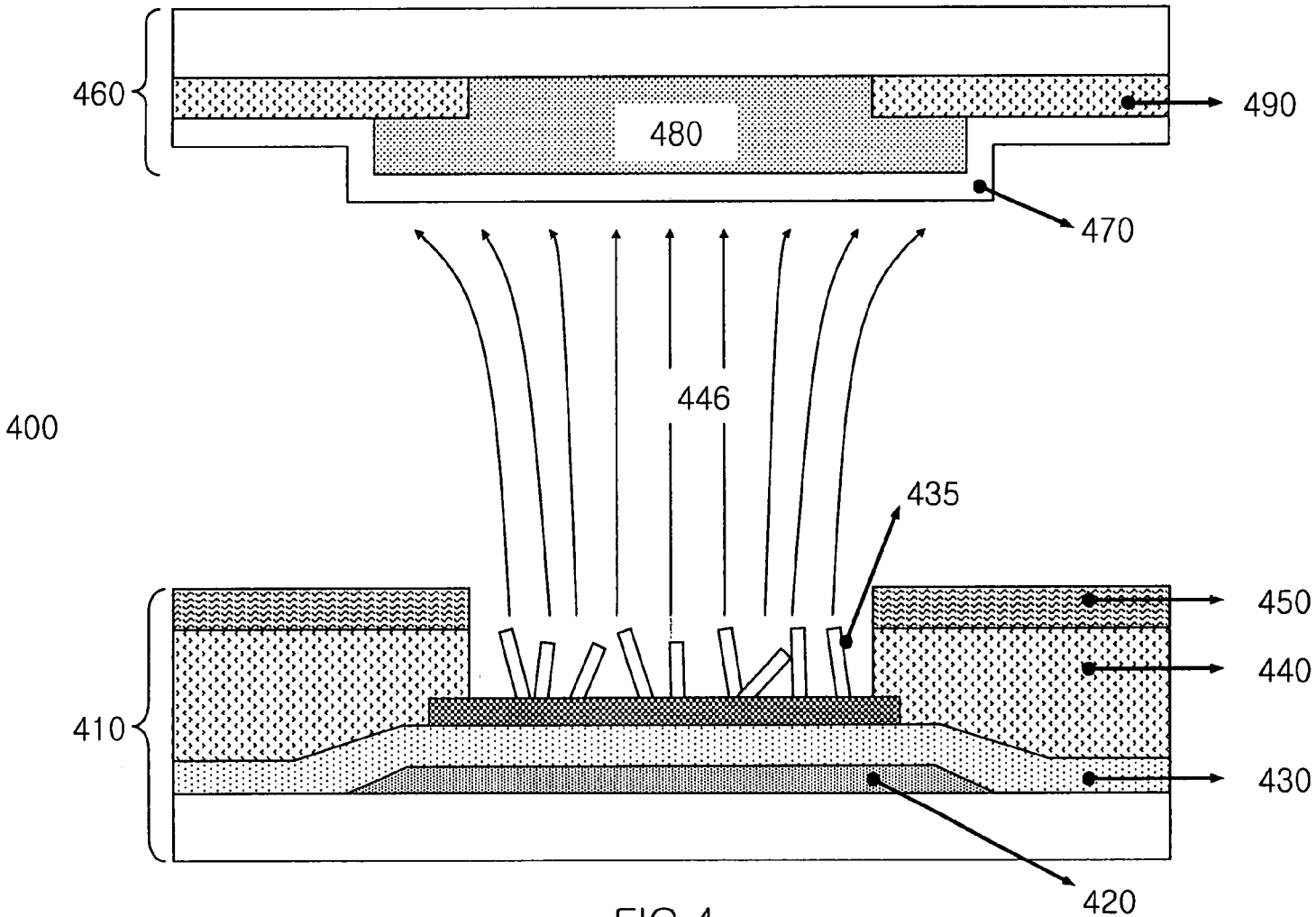
FIG. 4 illustrates a cross sectional structure of one embodiment of the FED device of the present invention.

FIG. 4 illustrates one embodiment of the carbon nanotube field emission display device of the present invention. The field emitter of FIG. 4, illustrates a multi-layer structure 400 which is a cross sectional view of a portion of an FED flat panel display. The multi-layer structure 400 comprises a field emission backplate structure 410. An image is generated at faceplate structure 460.

The backplate structure 410 generally comprises of a patterned emitter electrode 420, a resistor layer 430, an electrically insulating layer 440, a gate layer 450 and electron-emissive elements 435 situated in an aperture through insulating layer 440. The electron-emissive elements 435 are carbon based material.

In one embodiment of the present invention, the electron-emissive elements 435 are cylinical. In another embodiment of the present invention, the electron-emissive elements 435 are filaments.

The faceplate structure 460 is formed with an black matrix layer 490, an anode 470, and a coating of phosphors 480.

The emission of electrons from electron-emissive elements 435 is controlled by applying a suitable voltage ($V_g$) to the gate 450. Another voltage ($V_e$) is applied directly to the electron emissive element 435 by way of the emitter electrode 420. Electron emission decreases as the gate-to-emitter potential goes negative, e.g., in comparison with emitter electrode potential, as the potential of gate electrode decrease, the electron emission from the electron emissive elements decrease. Directing the electrons to the phosphor 480 is performed by applying a high voltage ($V_a$) to the anode 470.

In the present invention, gate electrodes have relative negative potential voltage compared to emitter electrodes or have an absolute negative voltage. Furthermore, electron emission from the electron emissive elements 435 is driven by high anode voltage. Thus, in one embodiment of the present invention, when the field emissive elements are turned on, the display device gets in a full brightness mode by the electron emission from the electron emissive elements 435 as determined by the voltage of anode potentials.

Unlike the prior art, the anode voltage $V_a$ is high enough to induce electron emission from the electron-emissive elements 435. The anode voltage $V_a$ also accelerates electron emission from the electron-emissive elements 435 to the faceplate 460. In one embodiment of the present invention, the anode voltage can be as high as 1 KV–20 KV during a turn on of the FED device 400. During operation of the device 400, the operating voltage on the anode 470 could reach as high as 20 KV.

Figure 5A:
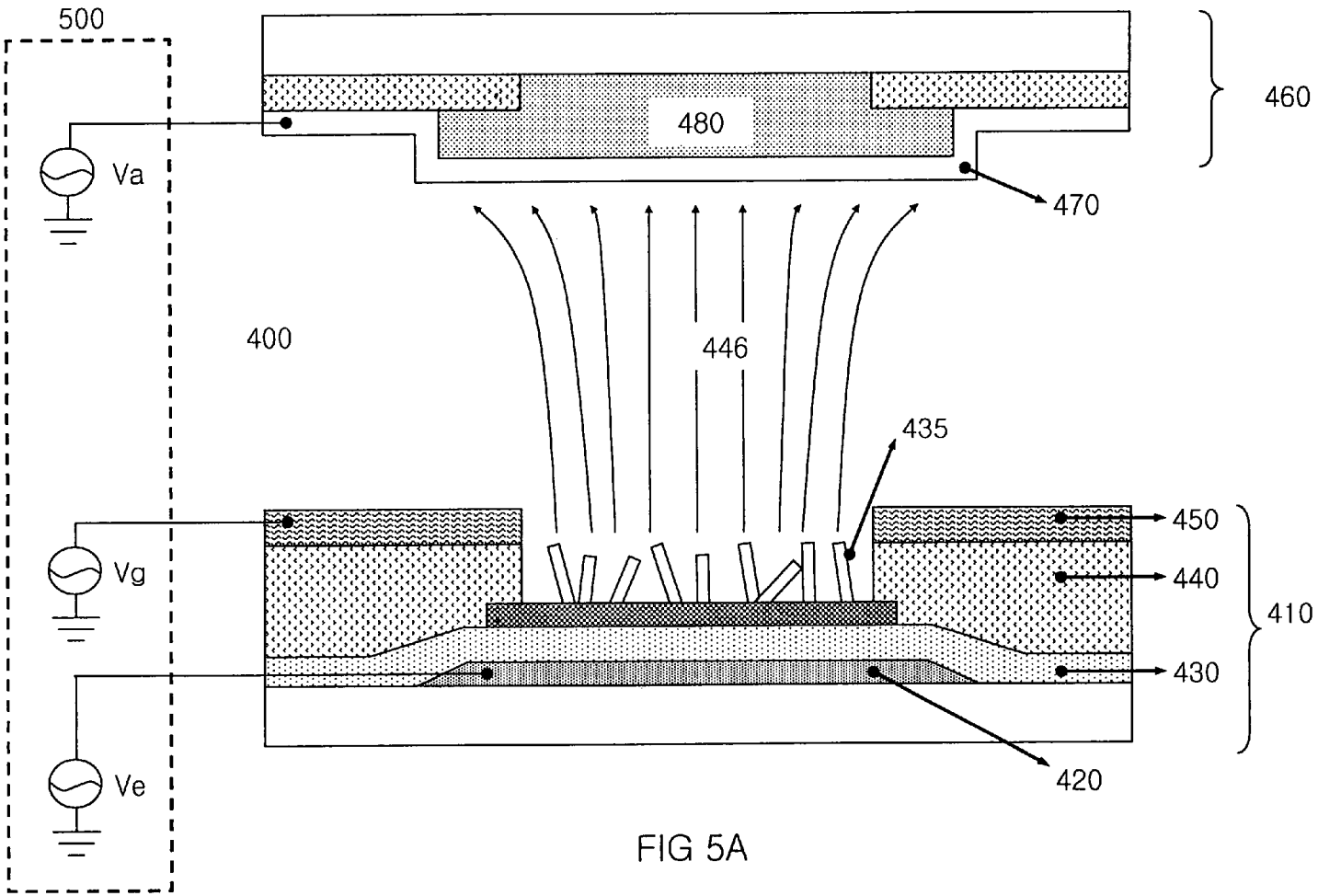
FIG. 5A illustrates an exemplary FED device with a negative voltage driving apparatus of the present invention.

FIG. 5A is a block diagram illustration of an apparatus for controlling the operation process of the FED device 400 of the present invention. The apparatus 500 comprises a first voltage controller for providing anode voltage to the anode 470.

In one embodiment of the present invention, the anode 460 is kept at an operating voltage range of 10 KV–20 KV. The apparatus 500 further comprises a second voltage controller coupled to provide gate voltage to the gate electrode 450. The gate voltage may range from −50V to 0V. A third voltage controller is coupled to provide emitter voltage to the emitter electrode 410. In one embodiment of the present invention, the emitter voltage may range from 0–30V In operation, the voltage controllers provide various voltages to the anode 460, the gate 450 and the emitter electrode 420 to the FED device 400 to provide different voltages and emission characteristics during operation of the FED device 400. In one embodiment of the present invention, the voltage of the anode is kept at a range of 1 KV to 20 KV.

A voltage differential between the anode voltage and the emitter electrode accelerates electrons towards the phosphor material. In one embodiment of the present invention, a negative voltage differential between the gate and the emitter electrode inhibits and controls electron emission from the emitter elements 435 and through this control of electron emission, the present invention ensures that gray scale control is available to the display device.

Conversely, when the voltage differential between the gate 450 and the emitter electrode 420 is positive or zero, the emitter elements emit electrons to the anode 470 or to the gate 450. In one embodiment of the present invention, the apparatus 500 modulates gray-scale images in the FED device 400 by controlling the voltage differential between the gate 450 and the emitter electrode 420 at a negative value between zero and the maximum voltage difference that can be applied to the gate 450 and emitter (i.e., −80V).

Figure 5B:
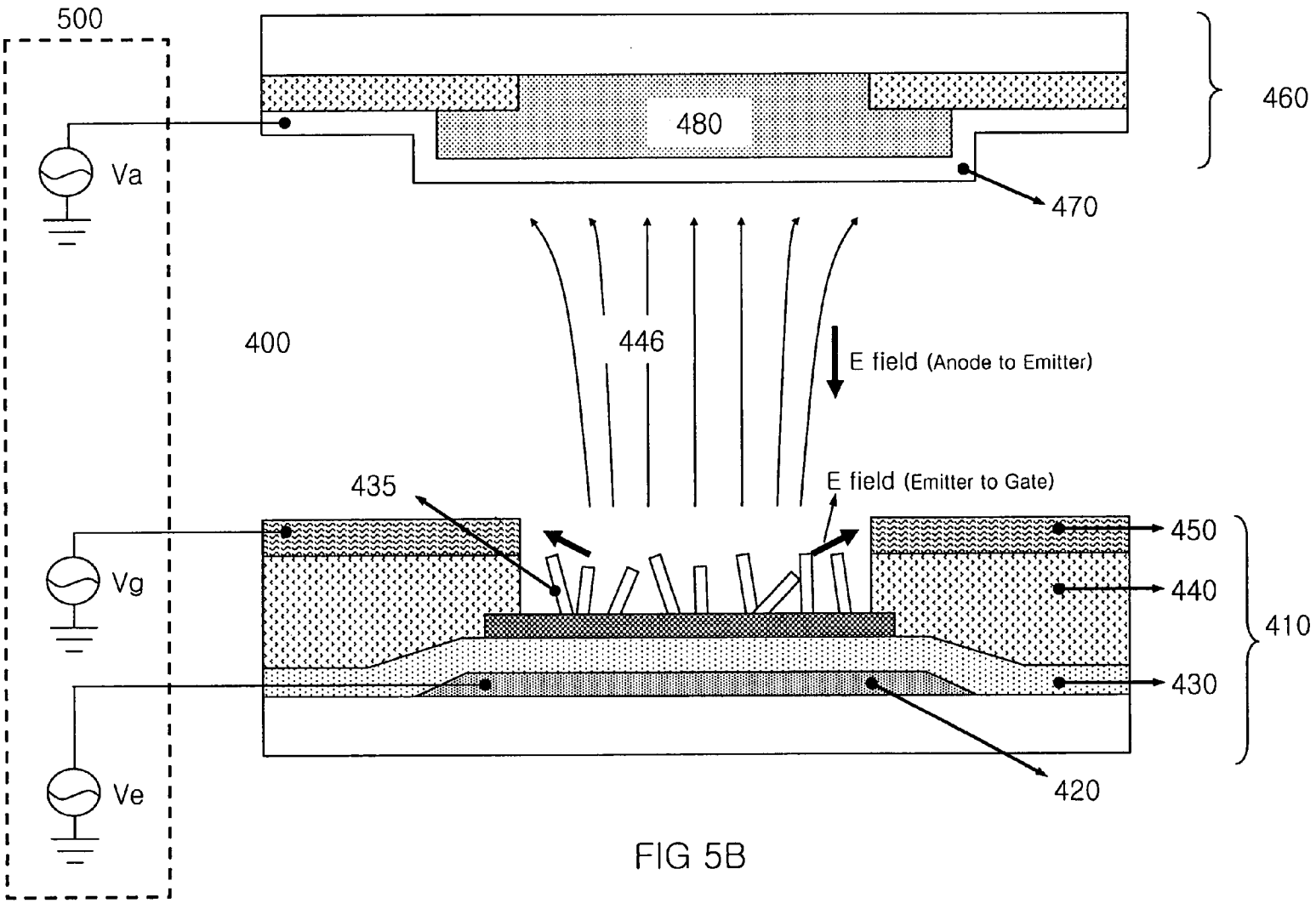
FIG. 5B illustrates an exemplary electric field of a FED device with a negative voltage driving apparatus of the present invention.

FIG. 5B is a block diagram of another embodiment of the apparatus 500 of the present invention. In the example illustrated in FIG. 5B, the apparatus 500 comprise the same components as that described in FIG. 5A.

In the embodiment shown in FIG. 5B, an electric field is created between the anode 470 and the emitter electrode 420 or the emitter electrode 420 and the gate 450 to necessitate electron emission from the emitter elements 435 and electron emission control. In the embodiment shown in FIG. 5B, the electric field is illustrated by the formula $$E=V/l$$

where: v is the voltage differential between either the anode and the emitter electrode or the emitter electrode and the gate;

where: l is the distance between the emitter electrode and the anode or the emitter electrode and the gate.

In one embodiment of the present invention, if the electric field between the emitter and the anode is greater than the electric field between the gate and the emitter electrode as defined by the absolute value of the voltage potential applied to both the gate and the emitter electrode, the emitter elements 435 emit electrons towards the anode 470. If, on the other hand, the electric field between the gate and the emitter is of the same absolute value or greater than the absolute negative value of the anode-to-emitter field (e.g., −20V/$\mu$m), then the emitter elements 435 are inhibited from emitting.

Figure 6:
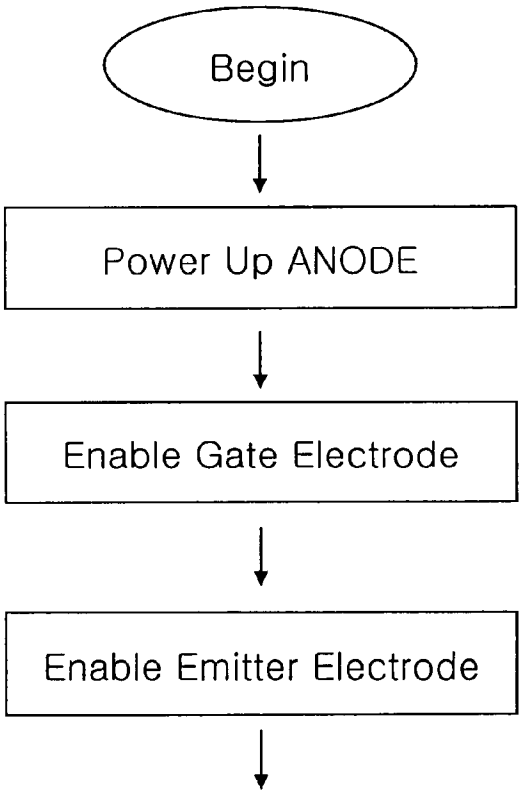
FIG. 6 is a flow diagram of the turn on procedure of an FED in accordance with one embodiment of the present invention.

FIG. 6 is a flow diagram of the operating process of the FED 400 of one embodiment of the present invention. At step 600, the FED device 400 is activated and the anode 470 is turned on at step 610. The anode voltage gradually is turned on to a threshold value of the emissive elements work-function and then increased to about 10 KV. At 10 KV the display device will exhibit full brightness.

At step 630, the gate is enabled by turning on the gate voltage controller. The gate voltage is maintained at a negative voltage (e.g., −15V) at step 640. The emitter electrode is then enabled by turning on the emitter voltage controller at step 650. The emitter electrode voltage is maintained at a positive voltage relative to the gate voltage to induce electron emission from the emitter elements 453 to the anode 470.

The electron emitters produced according to the invention can be employed to make flat-panel devices other than flat-panel CRT displays. Likewise, the present electron emitters can be used as electron sources in products other than flat-panel devices. Various modifications and applications may thus be made by those skilled in the art without departing from the true scope and spirit of the invention as defined in the appended claims.

We claim:

1. An electron-emitting display device comprising:

an emitter electrode;

a plurality of electron emission elements coupled to the emitter electrode;

an anode;

a gate electrode;

a phosphor for emitting light upon receiving energy from electrons emitted from the emitter electrode;

a first voltage controller for applying a first voltage potential between the emitter electrode and the anode, the emitter electrode held at a negative voltage potential relative to the anode, where the first voltage potential is sufficient to cause the emission of electrons from the electron emissive elements; and a second voltage controller for applying a second voltage potential between the gate electrode and the emitter electrode, the gate electrode held at a negative voltage potential relative to the emitter electrode, where the second voltage potential is sufficient to inhibit the emission of electrons from the electron emissive elements.

2. The device of claim 1, wherein the electron emissive elements emit electrons in a second operating mode, wherein the emitter electrode is held at a lower voltage potential than the anode and at a higher voltage potential than the gate electrode.

3. The device of claim 1, wherein emission of electrons by the electron emissive elements is completely inhibited in a third operating mode, wherein the gate electrode is held at a voltage potential sufficient to inhibit all electron emission from the electron emissive elements.

4. The device of claim 1, wherein the electron emissive elements are carbon nanotubes.

5. The display device of claim 1, wherein emission of electrons by the electron emissive elements is partially inhibited in a first operating mode, wherein the gate electrode is held at a voltage potential sufficient to inhibit a portion of the electron emission from the electron emissive elements.

6. An electron-emitting device comprising:

an emitter electrode;

a plurality of electron emission elements coupled to the emitter electrode;

an anode;

a gate electrode;

a phosphor for emitting light upon receiving energy from electrons emitted from the emitter electrode;

a first electric field from the anode to the emitter electrode, the first electric field sufficient to cause the emission of electrons from the electron emissive elements; and a second electric field from the emitter electrode to the gate electrode, the second electric field tending to inhibit the emission of electrons from the electron emissive elements.

7. The device of claim 6, wherein the electron emissive elements emit electrons in a second operating mode, wherein the second electric field is small enough to allow electron emission.

8. The device of claim 6, wherein emission of electrons by the electron emissive elements is completely inhibited in a third operating mode, wherein the second electric field is sufficient to inhibit all electron emission from the electron emissive elements.

9. The device of claim 6, wherein the electron emissive elements are carbon nanotubes.

10. The display device of claim 6, wherein emission of electrons by the electron emissive elements is partially inhibited in a first operating mode, wherein the second electric field is sufficient to inhibit a portion of the electron emission from the electron emissive elements.

11. A method for emitting electrons from a plurality of electron emissive elements in a field emissive display device, the device comprising a phosphor, an anode, a gate electrode, and an emitter electrode coupled to the electron emissive elements, the method comprising:

applying a first voltage potential between the emitter electrode and the anode, the emitter electrode held at a negative voltage potential relative to the anode, where the first voltage potential is sufficient to cause the emission of electrons from the electron emissive elements, and wherein the electrons emitted from the electron emissive elements provide energy to excite the phosphor, causing the phosphor to emit light; and applying a second voltage potential between the gate electrode and the emitter electrode, the gate electrode held at a negative voltage potential relative to the emitter electrode, where the second voltage potential tends to inhibit the emission of electrons from the electron emissive elements.

12. The method of claim 11, further comprising:

decreasing the second voltage potential to allow full electron emission from the electron emissive elements.

13. The method of claim 11, further comprising:

increasing the second voltage potential to inhibit all of the electron emission from the electron emissive elements.

14. The method of claim 11, wherein the electron emissive elements are carbon nanotubes.

15. The method of claim 11, further comprising:

increasing the second voltage potential to inhibit a portion of the electron emission from the electron emissive elements.

16. A method for emitting electrons from a plurality of electron emissive elements in a field emissive display device, the device comprising an anode, a gate electrode, and an emitter electrode coupled to the electron emissive elements, the method comprising:

applying a first voltage between the anode and the emitter electrode to create a first electric field from the anode to the emitter electrode, the first electric field sufficient to cause the emission of electrons from the electron emissive elements, and wherein the electrons emitted from the electron emissive elements provide energy to excite the phosphor, causing the phosphor to emit light; and applying a second voltage between the emitter electrode to the gate electrode to create a second electric field from the emitter electrode to the gate electrode, the second electric field tending to inhibit the emission of electrons from the electron emissive elements.

17. The method of claim 16, further comprising:

decreasing the second voltage to allow electron emission from the electron emissive elements.

18. The method of claim 16, further comprising:

increasing the second voltage to suppress all of the emission of electrons from the electron emissive elements.

19. The method of claim 16, wherein the electron emissive elements are carbon nanotubes.

20. The method of claim 16, further comprising:

increasing the second voltage to inhibit a portion of the emission of electrons from the electron emissive elements.

* * * * *